United States Patent [19]

Hertzberg

[11] 4,355,436

[45] Oct. 26, 1982

[54] VACUUM CLEANERS

[76] Inventor: Samuel Hertzberg, 29 Country Club La., Pomona, N.Y. 10970

[21] Appl. No.: 226,396

[22] Filed: Jan. 19, 1981

[51] Int. Cl.[3] ..... A47L 5/30

[52] U.S. Cl. ..... 15/383; 15/42; 15/366; 15/368; 15/374

[58] Field of Search ..... 15/42, 79, 368, 364, 15/383, 416, 366, 374

[56] References Cited

U.S. PATENT DOCUMENTS

| | | | |
|---|---|---|---|
| 436,689 | 9/1890 | Boggs | 15/42 |
| 604,783 | 5/1898 | Parbel et al. | 15/42 |
| 2,476,537 | 7/1949 | Erickson | 15/383 |
| 4,159,555 | 7/1979 | Schneider | 15/383 X |
| 4,219,902 | 9/1980 | DeMaagd | 15/364 |

FOREIGN PATENT DOCUMENTS

| | | | |
|---|---|---|---|
| 2258512 | 6/1973 | Fed. Rep. of Germany | 15/42 |
| 738479 | 10/1955 | United Kingdom | 15/344 |

*Primary Examiner*—Chris K. Moore

[57] ABSTRACT

Wall-floor edge cleaning ability in a vacuum cleaner is improved by a disk brush positioned rim with its bristles capable of floor contact and the hard, unyielding parts entirely contained in a gap in a bumper guard affixed to an exterior side wall of the housing. A stub shaft, loosely penetrating an aperture in the said housing side wall, is rigidly affixed at one extremity to the hub of the disk brush and at the other extremity axially to a free, unfettered end of a revolvable brush roll, the said brush roll horizontally supported within the nozzle area between the housing side walls. The disk brush is consequently revolvable with the brush roll. The disk brush may join the stub shaft end on a slightly oblique plane to assure better agitation of a carpet nap and direct penetration of a wall-floor edge by the rim bristles. To facilitate assembly and replacement of worn parts, the members are removably joined. A link-slot cutout in the hub section of the disk brush may be utilized as wear occurs to adjust rim bristle contact with a floor surface.

15 Claims, 12 Drawing Figures

VACUUM CLEANERS

The present invention, like my invention U.S. Pat. No. 4,222,146, is designed to improve the wall-floor edge cleaning capability of vacuum cleaners. Cleaners currently produced—which utilize power-driven brush rolls—generally do a good job. Performance at the edges, however, is relatively poor because the brush roll bristles are unable to sweep the edges or even reasonably close to them. Between the bristles and the edges could be a space of up to three-quarters of an inch consumed by supporting bearings fixed to the brush roll ends and the side walls of the housings, the side walls themselves, and the bumper guards affixed to the exterior walls of the housings. The aforementioned patent demonstrates that this space can be largely or even entirely salvaged by placing the supporting bearings away from the brush roll ends, namely on inner segments of the brush rolls. The brush roll ends thereby unencumbered, unfettered, free, may be extended directly to the housing side walls and, if desired, even through cutouts in the substance of the side walls. Thus, it is possible to plant bristle tufts in brush rolls that will reach closer to edges and even into edges.

My previous invention, to achieve maximum efficiency in edge cleaning, requires a cutout in the substance of the housing side wall adjacent to the free brush roll end which will allow the said brush roll end to revolve unimpeded in the space thereby formed. The revolving brush roll end may, if carelessly employed, mar a wall. The cutout, to those otherwise accustomed, may lack aesthetic appeal. The cutout is large enough to dissipate an appreciable amount of the suction power of the nozzle. And the cutout may seriously weaken the housing structure. It is the purpose of the present invention, in a novel arrangement of members, to eliminate these objections and to provide a more efficient edge cleaning device without adding appreciably to the cost of production. To accomplish this aim, it utilizes the free brush roll end already alluded to, but the cutout in the housing side wall (as described) is eliminated.

My invention, briefly summarized, consists of a power-driven disk brush (or a portion of a disk brush incorporating part of the rim section and its bristles and part of the hub section) positioned in a gap in the bumper guard, the latter affixed to an exterior side wall of the cleaner housing. The relative proportions of the members are such as to assure, as the bumper guard is run along a room wall, that the floor space between room wall and housing side wall is thoroughly swept by the bristles emanating from the disk brush rim section, the loosened dirt sucked into the cleaner nozzle. The room wall surface is protected by the bumper guard from contact with the hard, unyielding parts of the disk brush, but the bristles are designed to reach into the wall-floor edge.

The disk brush is rigidly affixed at its hub section to the end of a stub shaft. The balance of the stub shaft loosely penetrates a small aperture in the side wall of the cleaner housing and is in rigid and aligned axial engagement with the adjacent free end of a revolvable brush roll horizontally supported within the nozzle area of the cleaner between the side walls of the said housing. Preferably in accomplishing this, the disk brush hub section and the stub shaft end should be affixed to each other on an oblique plane so that the disk brush is slightly tilted relative to the axis of the brush roll. This type of construction assures a thorough agitation of the carpet area (previously alluded to) between room and cleaner walls. In any event, the rigid relating of the members immobilizes the disk brush, renders it incapable of independent motion, but leaves it revolvable with the brush roll.

The members, as I shall later detail, can be removably affixed to each other so that replacement of worn parts is easily accomplished. Furthermore, a link-slot cutout in the hub section of the disk brush (or disk brush portion) can be utilized, as wear occurs, to adjust contact of the rim section bristles with a floor surface.

The accompanying drawing is a representation of my invention and, in conjunction with the description which follows, reveals more precisely how the objects, novel features and advantages are achieved.

Figure 1:
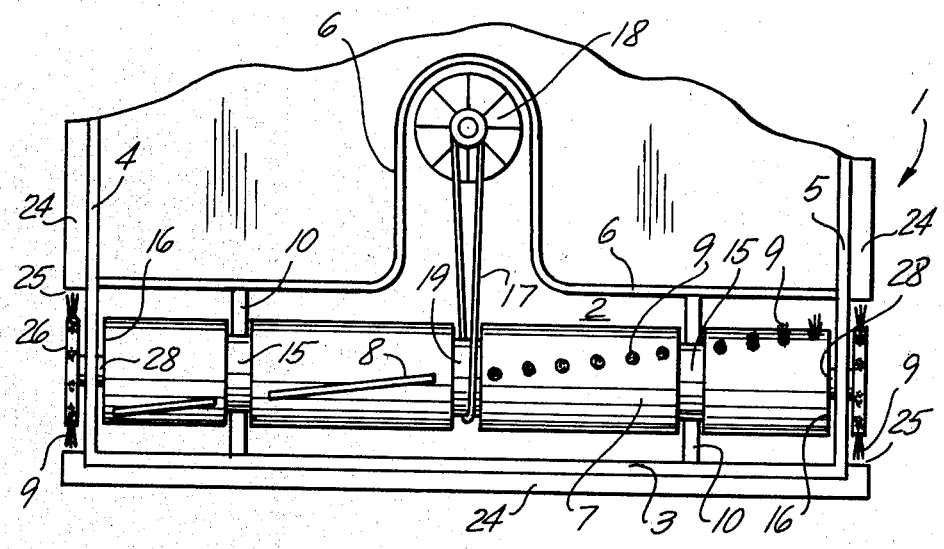
FIG. 1 is a plan view of a portion of the undercarriage of a vacuum cleaner comprising the nozzle area thereof.
Figure 2:
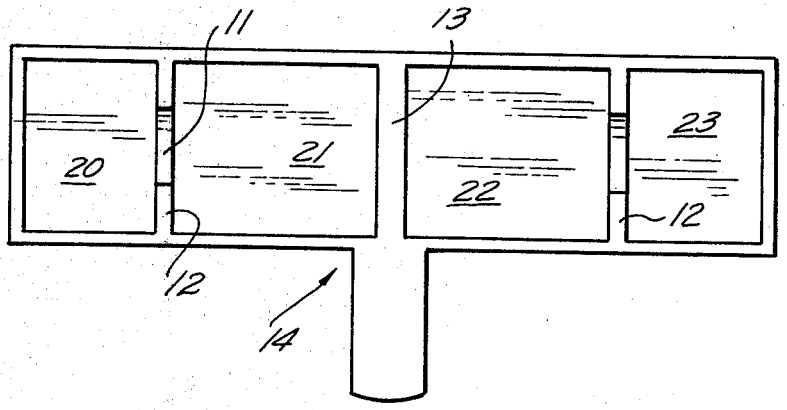
FIG. 2 is a plan view of the guard plate designed to be securely fastened to the nozzle area of the cleaner.

In FIG. 1 a portion of the undercarriage of a vacuum cleaner 1 comprising the entire nozzle area 2 is visible. This nozzle area 2 is the area within the housing bounded by the front wall 3, the side walls 4 and 5, and the air control wall 6. An essentially cylindrical revolvable brush roll 7, with beater bars 8 and bristle tufts 9, is horizontally supported in the nozzle area 2 between the side walls 4 and 5 in sectioned bearings, bearing sections 10 integrated with and emanating from nozzle area 2 structure and bearing sections 11 integrated with and emanating from bridges in the guard plate 14 (FIG. 2). These bearing sections 10 and 11, when the guard plate 14 is fitted and secured to the nozzle area 2, fit into and loosely surround respective bearing grooves 15 in the brush roll 7. It is apparent from this that the bearing sections 10 and 11 surround inner segments of the brush roll 7 and leave the brush roll end 16 unencumbered, unfettered, free of conventional bearing structure and available for other employment. The present invention, as will shortly be demonstrated, requires and utilizes such free brush roll ends 16. To conclude the description of the nozzle area 2: The drive belt 17 connects the motor spindle 18 with the belt groove 19 of the brush roll 7, rendering the latter revolvable. And the gaps 20, 21, 22, and 23 in the attached guard plate 14 (FIG. 2) when the cleaner 1 is in the operating posture, allow the bristle tufts 9 and the beater bars 8 to contact a floor surface.

As is customary with vacuum cleaners, the exterior side walls 4 and 5 as well as the front wall 3 (FIG. 1) have a bumper guard 24 affixed to them. There is a gap 25 in the bumper guard 24 at each of the side walls 4 and 5. In this gap 25, closely adjacent to each of the side walls 4 and 5, is positioned a disk brush 26. The latter, revolvable with the brush roll 7, has bristle tufts 9 which (when the apparatus is in the operating position) can contact a floor surface. These relationships are readily discernible in FIG. 3.

Figure 4:
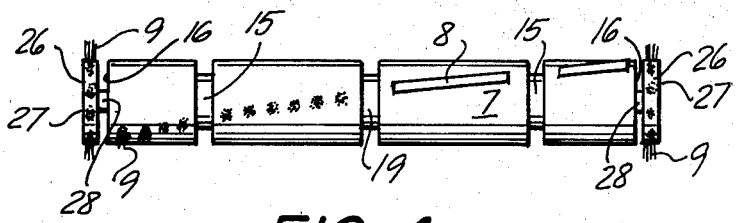
FIG. 4 is a front view of a brush roll removed from the nozzle area with a disk brush rigidly and irremovably attached to each free brush roll end.

For the disk brushes 26 to be revolvable with the brush roll 7, it is necessary to relate them to each other by means of stub shafts 28. This assembly, in its most elementary form, is the subject of FIG. 4. There a stub shaft 28—in each instance—is rigidly and irremovably affixed at one extremity to the hub section 27 of a disk brush 26 and similarly affixed at the other extremity to (and in axial alignment with) a free brush roll end 16. The disk brushes 26 are thus revolvable with the brush roll 7, but incapable of independent motion. That is exactly what is required. However, there are other considerations which cannot be ignored. Irremovable attachment of the members to each other would require replacement of the entire assembly should any particular part require it. Furthermore, since a portion of the assembly must be positioned within the cleaner 1 housing and a portion without, the side walls 4 and 5 present a problem. This obstacle can be overcome by removing an appropriate section 29 (broken lines in FIG. 6D) of the side walls 4 and 5. Subsequently, these sections 29 can be slotted back into position, leaving apertures 30 which the stub shafts 28 can loosely penetrate. A side effect, unfortunately, would be a weakened housing structure. The best solution, all things considered, would be to affix the members rigidly but removably to each other.

Figure 3:
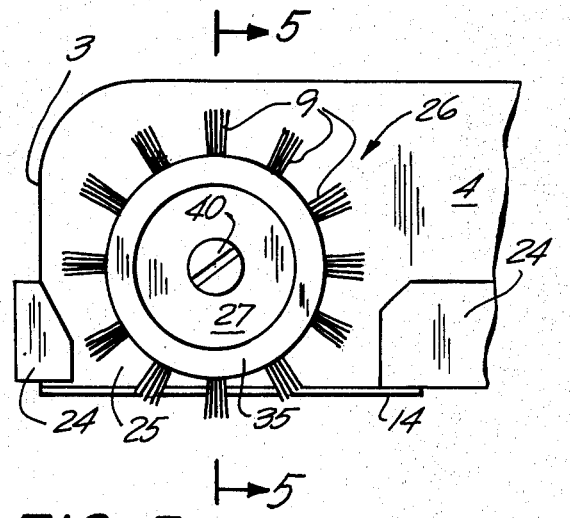
FIG. 3 is a view in the operating position of a portion of the cleaner showing an exterior side wall of the housing adjacent the nozzle area and a related disk brush situated in a gap in the bumper guard.
Figure 5:
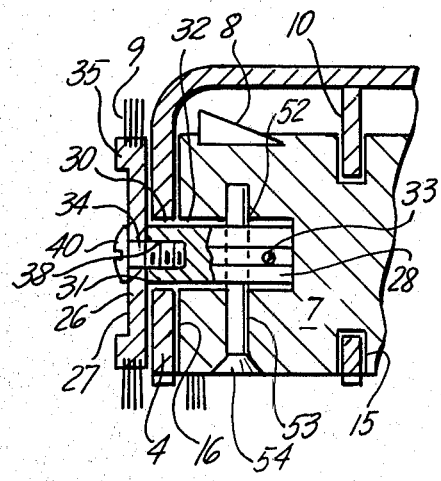
FIG. 5 is a portion of a section on the line 5—5 of FIG. 3 showing a disk brush rigidly and removably attached to a stub shaft end, the balance of the stub shaft in rigid and removable engagement with an axial recess in a free brush roll end.

FIG. 5, a portion of a section on the line 5—5 of FIG. 3, reveals a disk brush 26 rigidly and removably affixed at its hub section 27 to an end 31 of a stub shaft 28 by a rod with means overlapping a penetrated part of the hub section 27 connecting with the stub shaft end 31 pressing the disk brush 26 firmly against the stub shaft end 31. In this instance, the rod is a bolt 34 (with an overlapping head 40) threaded into a recess 38 in the substance of the stub shaft 28. Other features designed to keep the disk brush 26 immobilized in this position, incapable of movement independent of the brush roll 7 should the bolt 34 loosen its hold, will be detailed in connection with FIG. 6. The balance of the stub shaft 28, loosely penetrating the aperture 30 in the side wall 4, is in rigid and removably splined engagement with an aligned axial recess 32 in the substance of the free brush roll end 16, the compatible splining supplemented by a compressible detent 33 involving both. The latter removable arrangement obviates the need for a slotted wall section 29; it permits independent replacement of the brush roll 7 and the disk brush 26—stub shaft 28 combination.

It is the purpose of FIG. 6, in the ordered sequence of members there depicted, to allow an individual detailed scrutiny of each (and possible substitutes for each), always (though not exclusively) focussing on the objective of a rigid and removable combination of them.

Figure 6A:
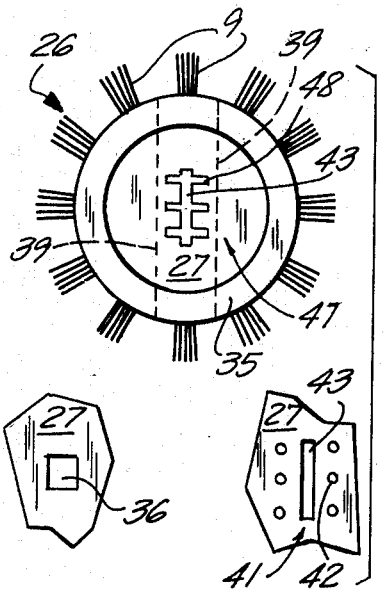
FIG. 6A is a plan view of one side of a disk brush with a ladder type link-slot cutout in the countersunk hub section, supplemented by two hub section portions illustrating alternative methods of treating the hub section.

The disk brush 26 of FIG. 6A reveals features additional to those discernible in the other figures. It is flat on one side, the side not visible here and intended to be positioned adjacent the housing exterior side wall 4 (or 5). The obverse (here illustrated) is countersunk in the hub section 27. This provides a relatively thick rim section 35 from whose circumference bristle tufts 9 emanate, while assuring that any member protruding from the hub section 27 (the bolt head 40, for instance) will not extend beyond the rim section 35 and mar a wall surface.

Figure 6B:
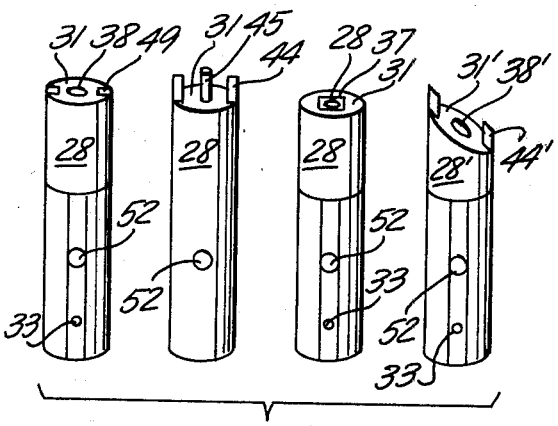
FIG. 6B depicts four stub shafts and is designed to indicate possible variations in detail required to accomodate to the different methods of treating the hub section of the disk brush.
Figure 6C:
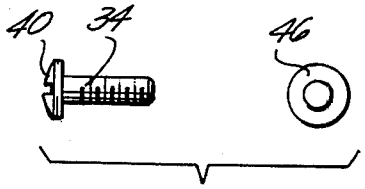
FIG. 6C depicts a bolt and a nut, one or the other required to fasten the disk brush to the selected stub shaft end.

The disk brush 26 is to be rigidly and removably affixed at the hub section 27 to a stub shaft end 31 (FIG. 6B). The least versatile method of accomplishing this would be by means of a square slot cutout 36 in the hub section 27 (FIG. 6A) penetrated by a close-fitting complementing sprocket 37 from a stub shaft end 31 (FIG. 6B). The latter has a threaded recess 38 into which can be fitted the threaded connecting bolt 34 (FIG. 6C), the head 40 overlapping the slot 36 and pressing the disk brush 26 firmly against the stub shaft end 31. Obviously, to achieve this result the sprocket 37 must not project beyond the level of the hub section 27. This holds as well for other sprockets yet to be described.

A second method for rigidly and removably affixing the disk brush 26 to the stub shaft end 31 utilizes a link-slot cutout 41 in the hub section 27 (FIG. 6A) consisting of links 42 and a slot 43. Paired links 42 are penetrated by comparably spaced sprockets 44 and the slot 43 is penetrated by the rod 45, projections from the stub shaft end 31 (FIG. 6B). Thereafter, an overlapping nut 46 (FIG. 6C) threaded to the rod 45 (which is suitably proportioned) completes the assembly. If preferred, a cotter pin or cotter plate (neither illustrated) can be utilized instead of the nut 46.

A third method uses a ladder type link-slot cutout 47 (FIG. 6A), the links 48 integrated with the slot 43. Rung sprockets 49 or correctly spaced sprockets 44, accompanied by either the connecting bolt 34 or connecting rod 45 fastening arrangement (already described), can be utilized to achieve the desired result.

Some observations are pertinent here. In the last two methods, a single sprocket 44 or 49 (though two, as illustrated, is preferable), in conjunction with the connecting rod 45 or connecting bolt 34, will suffice to immobilize the disk brush 26. Certain types of members in these assemblies (such as sprockets and overlapping rods and bolts) are interchangeable; and a variety of combinations is thereby possible. Finally to generalize: In any arrangement for rigidly and removably relating a disk brush 26 to a stub shaft end 31, a sprocket (or sprockets) must cooperate with a rod with means overlapping a slot penetrating the slot and connecting with the stub shaft end pressing the disk brush hub section firmly against the stub shaft end.

The link-slot cutouts 41 and 47 in the hub section 27 have a function additional to that already described.

When the disk brush 26 is new, connection is made with the stub shaft end 31 by engaging the slot 43 and, depending on the particular link-slot cutout utilized in the assembly, one (or a pair of) centrally positioned link(s) 42 or 48. This attaches the disk brush 26 at its center and, in use, assures equal wear of the bristle tufts 9 along the entire rim section 35 circumference. However, as the bristle tufts 9 wear down sufficiently, another link (or pair of links) 42 or 48 can be substituted. This will bring a portion of the bristle tufts 9 into renewed contact with a floor surface, though an opposed portion of the bristle tufts 9 will be affected adversely. This is of no real consequence, since the number of functioning bristle tufts 9 is not a critical factor. Subsequently, the opposed portion of bristle tufts 9 can be reactivated in similar fashion. This successive selection and utilization of links 42 or 48 serves to adjust contact of the bristle tufts 9 with a floor surface, thereby considerably prolonging the useful life of the disk brush 26.

It is to be noted, that though reference heretofore has been limited to a disk brush 26, that actually a mere portion of such a disk brush 26 (such as that delineated, for instance, by the broken lines 39 in FIG. 6A) will function adequately for all of the aforesaid purposes, providing the said portion 39 includes at least a portion of the rim section 35 and its bristles 9 and a sufficient portion of the hub section 27.

Figure 6D:
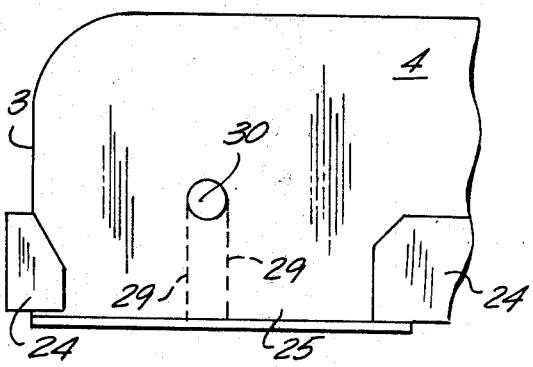
FIG. 6D is a plan view of a portion of the exterior side wall of the cleaner housing as it would appear with the disk brush removed.
Figure 6E:
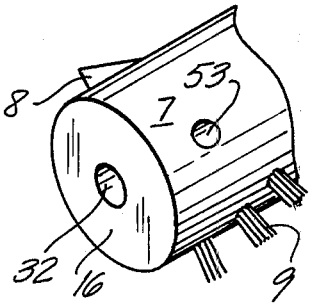
FIG. 6E is a view in perspective of a portion of the brush roll showing a free, unfettered end.

With the disk brush 26 (or disk brush portion 39) rigidly and removably affixed to the stub shaft end 31, the balance of the stub shaft 28 is passed through the aperture 30 in the housing side wall 4 (FIG. 6D), a loose-fitting penetration, into rigid and removable engagement with the axial recess 32 in the brush roll free end 16 (FIG. 6E). This latter arrangement requires that the balance of the stub shaft 28 be held immobile in the recess 32 while the cleaner 1 is functioning, but nevertheless be subject to disengagement at the will of the operator. There are several ways of accomplishing this. One method, compatible splining of the members 28 and 32 supplemented by a compressible detent 33, has already been described in connection with FIG. 5. A second method is to thread the stub shaft 28 into the axial recess 32, the direction of the threading designed (on revolution of the brush roll 7) to maintain the stability of the relationship. A third method, whose description follows, is illustrated in FIG. 5.

With the nozzle area 2 exposed as in the FIG. 1 position, the brush roll 7 is turned by hand till the opening of the passage 53 is revealed. This passage 53 is directed on a radial line from the circumference of the brush roll 7 to make right angled connection with the axial recess 32. It is possible, as well, to position an engaged balance of the stub shaft 28 so that its channel 52 is aligned with the said passage 53 and is in effect an extension of it. A detent rod 54 may now be passed through the passage 53 into at least partial penetration of the aligned stub shaft channel 52. This will immobilize the stub shaft 28, providing the detent rod 54 is itself fixed in position. This latter result can be best achieved by threading the detent rod 54 into the passage 53 and/or the channel 52. Alternatively, a compressible detent relationship is also feasible. The assembly is, obviously, separable.

Before leaving FIG. 6D, it is necessary to amplify somewhat statements earlier made respecting confinement of the disk brush 26 to the gap 25 in the bumper guard 24. The intent here is to demonstrate that, with proper proportioning of the members, this is a practicable means of protecting (from abrasive action of the disk brush 26) a wall which the bumper guard 24 may contact.

The suggested proportions are these: Assuming a bumper guard 24 of conventional thickness (projecting about ¼ of an inch from the side wall 4), the disk brush 26 at its rim section 35 could be 3/16 of an inch thick. This would be quite adequate for the planting of bristle tufts 9 along its circumference. If the countersunk hub section 27 is 1/16 of an inch thick, this would allow up to 2/16 of an inch for the overlapping head 40 or the overlapping nut 46. Thus, the hard, unyielding parts of the disk brush 26 would at no point be more than 3/16 of an inch thick. We can then allow 1/32 of an inch between the side wall 4 and the flat side of the disk brush 26, enough for unimpeded rotation. There would remain, therefore, 1/32 of an inch clearance between the room wall and the hard parts of the disk brush 26. The spreading of the bristles 9 on floor contact would be an edge cleaning advantage.

We come, finally, to FIG. 7 whose subject is the affixing of the disk brush 26 (or disk brush portion 39) to the stub shaft end 31′ on an oblique plane. The section portion of FIG. 5, divested for simplification of various members, is utilized.

Figure 7A:
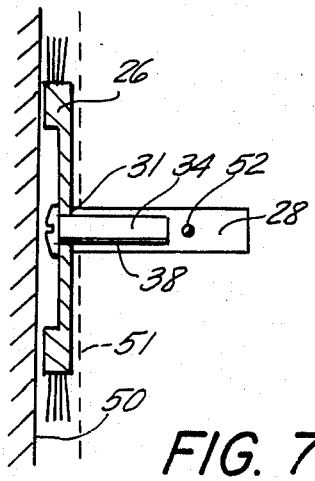
FIG. 7A, in the same section portion as FIG. 5, utilizes only such members as necessary to illustrate the effects of affixing a disk brush on an oblique plane to the end of a stub shaft.

In FIG. 7A, the stub shaft 28 has the usual stub shaft end 31 which (aside from the previously described projections therefrom) is finished on a plane calculated to leave its surface parallel to the line 50 (representing the plane of a room wall) and the broken line 51 (representing the parallel plane of a housing side wall 4). The disk brush is, consequently, affixed to the stub shaft end 31 so that both its sides (exclusive of the countersunk hub section 27) are on planes parallel to those of the enumerated members. It follows, since the balance of the stub shaft 28 is to be received in the axial recess 32 of the brush roll 7, that the disk brush 26 will be held perpendicular to the axis of the brush roll 7.

Figure 7B:
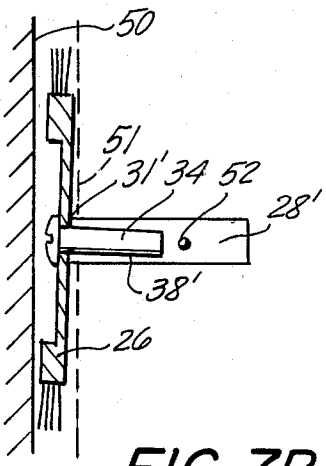
FIG. 7B shows the same elements as FIG. 7A with the end of the stub shaft in a plane oblique to its axis.

In FIG. 7B, the depicted stub shaft 28′ is utilized to effect a somewhat different result. The stub shaft end 31′ is finished on a bias; i.e., on an oblique plane. The disk brush 26, affixed to the stub shaft end 31′, will (conforming to the oblique plane of the stub shaft end 31′) no longer have its sides parallel to the lines 50 and 51. Nor will it be set perpendicular to the axis of the brush roll 7; it will now be tilted in relation to it. The connecting bolt 34 will have to be threaded into the recess 38′ at a slight angle. Finally, accomodating to the tilt of the disk brush 26, the distance between the walls 50 and 51 is widened, requiring a commensurate thickening of the bumper guard 24 (if the latter is to function as desired to protect the wall 50).

There is a disadvantage to the assembly of FIG. 7B. Augmenting the distance between the walls 50 and 51 reduces in some degree the effectiveness of the suction power of the nozzle area 2 in the floor space affected. A moderate tilting, one barely perceptible, is therefore recommended. Loss of suction power, in that event, would be very small; but the advantages derived would be considerable.

What are those advantages? As the tilted dish brush 26 revolves with the brush roll 7, the bristles 9 (responding to the obliquity) create two sets of furrows in the floor area between the walls 50 and 51 which crisscross as movement toward the wall 50 is followed by movement toward the wall 51. The agitation of a carpet nap is, consequently, more thorough than in the example of FIG. 7A. Furthermore, the bristles 9 in each spiraling movement are angled eventually either directly into the wall—floor edge or the side wall 4—floor edge. Finally, spiraling from the line 50 toward the line 51 throws the dirt from the area of poorest suction effect to the area of greatest suction effect. The contrary spiraling, from line 51 toward line 50, is not appreciably countervailing since it commences at an area of superior suction effect.

It should be noted, before concluding, that a method alternative to that just described for imparting obliquity is feasible. It is possible to finish the flat side of the disk brush 26 at the hub section 27 with an equivalent oblique plane. The usual stub shaft 28 would then have to be utilized. All other factors, including results, would be similar.

Having now described the improvement in vacuum cleaners of my invention, it must be understood that additional modifications and adaptations falling within the scope of the claims may occur to those skilled in the art.

I claim:

1. In a vacuum cleaner characterized by a revolvable brush roll horizontally supported in the nozzle area within the side walls of a housing, the combination of a brush roll with a free end, an aperture in the side wall of the housing adjacent the said free end in axial alignment with it, a stub shaft, at least a portion of a disk brush incorporating at least a portion of the rim section and its circumference bristles and a portion of the hub section, and a bumper guard with a gap therein affixed to the aforesaid exterior side wall of the housing, the gap adjacent the aperture; the disk brush portion positioned within the gap in the bumper guard rigidly affixed at the hub section to an end of the stub shaft and the balance of the stub shaft loosely penetrating the aperture in the housing side wall in rigid axial engagement with the brush roll end, the rim bristles capable of making contact with a floor surface, and the hard, unyielding parts of the disk brush portion confined within the aforesaid gap; the disk brush portion thereby revolvable with the brush roll and the room wall protected against abrasion as the bumper guard is run along a wall-floor edge.

2. A vacuum cleaner according to claim 1 further characterized by means for affixing the disk brush portion to the stub shaft end consisting of a slot in the hub section of the disk brush portion removably penetrated by a sprocket emanating from the said stub shaft end, a rod with means overlapping the slot removably penetrating the slot and connecting with the stub shaft end pressing the hub section firmly against the stub shaft end.

3. A vacuum cleaner according to claim 1 further characterized by means for affixing the disk brush portion to the stub shaft end consisting of a link-slot cutout in the hub section of the disk brush portion, at least one sprocket emanating from the stub shaft end removably penetrating a link, and a rod with means overlapping the slot removably penetrating the slot and connecting with the stub shaft end pressing the hub section firmly against the stub shaft end, the successive utilization of links in conjunction with the slot serving to adjust contact of the rim bristles with a floor surface.

4. A vacuum cleaner according to claim 1 further characterized by an axial recess in the brush roll end receiving and holding in removable immobile engagement the balance of the stub shaft, an arrangement achieved by compatible splining of axial recess and stub shaft supplemented by a compressible detent involving both.

5. A vacuum cleaner according to claim 1 further characterized by an axial recess in the brush roll end receiving and holding in removable immobile engagement the balance of the stub shaft, an arrangement achieved by threading the stub shaft into the axial recess, the direction of the threading designed on revolution of the brush roll to maintain the stability of the arrangement.

6. A vacuum cleaner according to claim 1 further characterized by an axial recess in the brush roll end receiving and holding in removable immobile engagement the balance of the stub shaft, an arrangement achieved by means consisting of a passage on a radial line connecting the circumference of the brush roll with the aforesaid axial recess, an aligned channel in the stub shaft, and a detent rod rigidly and removably penetrating the connecting passage and at least partially penetrating the axial recess and the aligned stub shaft channel.

7. A vacuum cleaner according to claim 1 further characterized by the disk brush portion part of a disk brush including a disk flat on the side positioned adjacent the side wall of the cleaner housing and the obverse countersunk in the hub section, the disk brush portion affixed to the stub shaft end by means of a slot in the hub section removably penetrated by a sprocket emanating from the said stub shaft end and a rod with means overlapping the slot removably penetrating the slot and connecting with the stub shaft end pressing the hub section firmly against the stub shaft end, the overlapping member thereby positioned in the countersunk area of the hub section its protrusion toward a room wall reducible accordingly.

8. A vacuum cleaner according to claim 1 further characterized by the disk brush portion and the stub shaft end affixed to each other on an oblique plane, the disk brush portion consequently tilted relative to the axis of the brush roll and capable of providing thereby more thorough agitation of a floor surface by crisscrossing action of the contacting bristles and direct alternate angling of them into room wall-floor edges and housing side wall-floor edges.

9. A vacuum cleaner according to claim 1 further characterized by the disk brush portion part of a disk brush including a disk flat on the side positioned adjacent the side wall of the cleaner housing and the obverse countersunk in the hub section, the said hub section having a link-slot cutout wherewith at least one sprocket emanating from the stub shaft end removably penetrates a link and a rod with means overlapping the slot removably penetrates the slot and connects with the stub shaft end pressing the hub section firmly against the stub shaft end, the overlapping member thereby positioned in the countersunk area of the hub section its protrusion toward a room wall reducible accordingly and the successive utilization of links in conjunction with the slot serving to adjust contact of the rim bristles with a floor surface.

10. A vacuum cleaner according to claim 1 further characterized by the disk brush portion part of a disk brush including a disk flat on the side positioned adjacent the side wall of the cleaner housing and the obverse countersunk in the hub section; the said hub section having a link-slot cutout wherewith at least one sprocket emanating from the stub shaft end removably penetrates a link and a rod with means overlapping the slot removably penetrates the slot and connects with the stub shaft end pressing the hub section firmly against the stub shaft end, the overlapping member thereby positioned in the countersunk area of the hub section its protrusion toward a room wall reducible accordingly and the successive utilization of links in conjunction with the slot serving to adjust contact of the rim bristles with a floor surface; and an axial recess in the brush roll end and means for removable immobilizing engagement of the balance of the stub shaft and the said axial recess.

11. A vacuum cleaner according to claim 1 further characterized by the disk brush portion part of a disk brush including a disk flat on the side positioned adjacent the side wall of the cleaner housing and the obverse countersunk in the hub section; the disk brush portion affixed to the stub shaft end on an oblique plane by means of a slot in the hub section removably penetrated by a sprocket emanating from the said stub shaft end and a rod with means overlapping the slot removably penetrating the slot and connecting with the stub shaft end pressing the hub section firmly against the stub shaft end, the overlapping member thereby positioned in the countersunk area of the hub section its protrusion toward a room wall reducible accordingly and the disk brush portion tilted relative to the axis of the brush roll and capable of providing thereby more thorough agitation of a floor surface by the crisscrossing action of the contacting bristles and the direct alternate angling of them into room wall-floor edges and housing side wall-floor edges.

12. A vacuum cleaner according to claim 1 further characterized by the disk brush portion affixed to the stub shaft end on an oblique plane by means of a link in a link-slot cutout in the hub section of the disk brush portion removably penetrated by a sprocket emanating from the stub shaft end and a rod with means overlapping the slot removably penetrating the slot and connecting with the stub shaft end pressing the hub section firmly against the stub shaft end; the disk portion consequently tilted relative to the axis of the brush roll and capable of providing thereby more thorough agitation of a floor surface of the crisscrossing action of the contacting bristles and the direct alternate angling of them into room wall-floor edges and housing side wall-floor edges, the successive utilization of links in conjunction with the slot serving to adjust contact of the rim bristles with a floor surface.

13. A vacuum cleaner according to claim 1 further characterized by the disk brush portion and the stub shaft end affixed to each other on an oblique plane, the disk brush portion consequently tilted relative to the axis of the brush roll and capable of providing thereby more thorough agitation of a floor surface by crisscrossing action of the contacting bristles and direct alternate angling of them into room wall-floor edges and housing side wall-floor edges; and an axial recess in the brush roll end receiving and holding in removable immobile engagement the balance of the stub shaft, an arrangement achieved by means consisting of a passage on a radial line connecting the circumference of the brush roll with the aforesaid axial recess, an aligned channel in the stub shaft, and a detent rod rigidly and removably penetrating the connecting passage and at least partially penetrating the axial recess and the aligned stub shaft channel.

14. A vacuum cleaner according to claim 1 further characterized by the disk brush portion part of a disk brush including a disk flat on the side positioned adjacent the side wall of the cleaner housing and the obverse countersunk in the hub section; the disk brush portion affixed to the stub shaft end on an oblique plane by means of a link in a link-slot cutout in the hub section of the disk brush portion removably penetrated by a sprocket emanating from the stub shaft end and a rod with means overlapping the slot removably penetrating the slot and connecting with the stub shaft end pressing the hub section firmly against the stub shaft end; the overlapping member thereby positioned in the countersunk area of the hub section its protrusion toward a room wall reducible accordingly, the disk brush portion tilted relative to the axis of the brush roll and consequently capable of providing more thorough agitation of a floor surface by crisscrossing action of the contacting bristles and direct alternate angling of them into room wall-floor edges and housing side wall-floor edges, and the successive utilization of links in conjunction with the slot serving to adjust contact of the rim bristles with a floor surface.

15. A vacuum cleaner according to claim 1 further characterized by the disk brush portion part of a disk brush including a disk flat on the side positioned adjacent the side wall of the cleaner housing and the obverse countersunk in the hub section; the disk brush portion affixed to the stub shaft end on an oblique plane by means of a link in a link-slot cutout in the hub section of the disk brush portion removably penetrated by a sprocket emanating from the stub shaft end and a rod with means overlapping the slot removably penetrating the slot and connecting with the stub shaft end pressing the hub section firmly against the stub shaft end; and an axial recess in the brush roll end receiving and holding in removable immobile engagement the balance of the stub shaft, an arrangement achieved by means consisting of a passage on a radial line connecting the circumference of the brush roll with the aforesaid axial recess, an aligned channel in the stub shaft, and a detent rod rigidly and removably penetrating the connecting passage and at least partially penetrating the axial recess and the aligned stub shaft channel; the overlapping member thereby positioned in the countersunk area of the hub section its protrusion toward a room wall reducible accordingly, the disk brush portion tilted relative to the axis of the brush roll and consequently capable of providing more thorough agitation of a floor surface by crisscrossing action of the contacting bristles and direct alternate angling of them into room wall-floor edges and housing side wall-floor edges, and the successive utilization of links in conjunction with the slot serving to adjust contact of the rim bristles with a floor surface.

* * * * *